United States Patent [19]

Lindner

[11] Patent Number: 4,863,358

[45] Date of Patent: Sep. 5, 1989

[54] SUBMERSIBLE POSITIVE DISPLACEMENT PISTON PUMP

[75] Inventor: Georg H. Lindner, Vlissingen, Netherlands

[73] Assignee: M&T Chemicals Inc., Sommerville, N.J.

[21] Appl. No.: 165,068

[22] Filed: May 14, 1988

[51] Int. Cl.[4] ..... F04B 19/04

[52] U.S. Cl. ..... 417/500; 222/385

[58] Field of Search ..... 417/492, 500; 222/385, 222/377; 92/40; 403/61, 98, 116

[56] References Cited

U.S. PATENT DOCUMENTS

| | | | |
|---|---|---|---|
| 579,006 | 3/1897 | Palmbla | 417/500 X |
| 865,315 | 9/1907 | Parr | 417/500 X |
| 4,575,317 | 3/1986 | Lindner | 417/500 |

FOREIGN PATENT DOCUMENTS

| | | | |
|---|---|---|---|
| 160508 | 3/1921 | United Kingdom | 417/500 |

*Primary Examiner*—Leonard E. Smith

*Attorney, Agent, or Firm*—S. A. Marcus; R. B. Henn; R. G. Ort

[57] ABSTRACT

A submersible positive displacement piston pump includes a cylinder for insertion within a body of liquid, the cylinder including a working end and an opposite end, an inlet port, an outlet port and a working chamber bounded by the outlet port and the working end; a piston rotatably and reciprocably movable in the cylinder between a retracted positon and an extended position for pumping liquid from the inlet port to the outlet port, the piston including a free end having a recessed section alternately in fluid communication with the inlet port and the outlet port; a pivoting assembly pivotally connected to a drive motor which rotatably and reciprocably drives the piston in the cylinder; and an extension assembly for connecting the pivoting assembly to the piston and for ensuring that the pivoting assembly and the drive motor are positioned out of the body of liquid when the piston and cylinder are positioned in the body of liquid, the extension assembly including a shaft extension for connecting the pivoting assembly to the piston, and a hollow extension pipe surrounding the shaft extension, the extension pipe being connected to the opposite end of the cylinder in a sealing relation and having an aperture spaced slightly from the sealing connection for maintaining a liquid seal at the opposite end of the cylinder when the level of the body of liquid falls below the opposite end of the cylinder.

14 Claims, 2 Drawing Sheets

FIG. 1
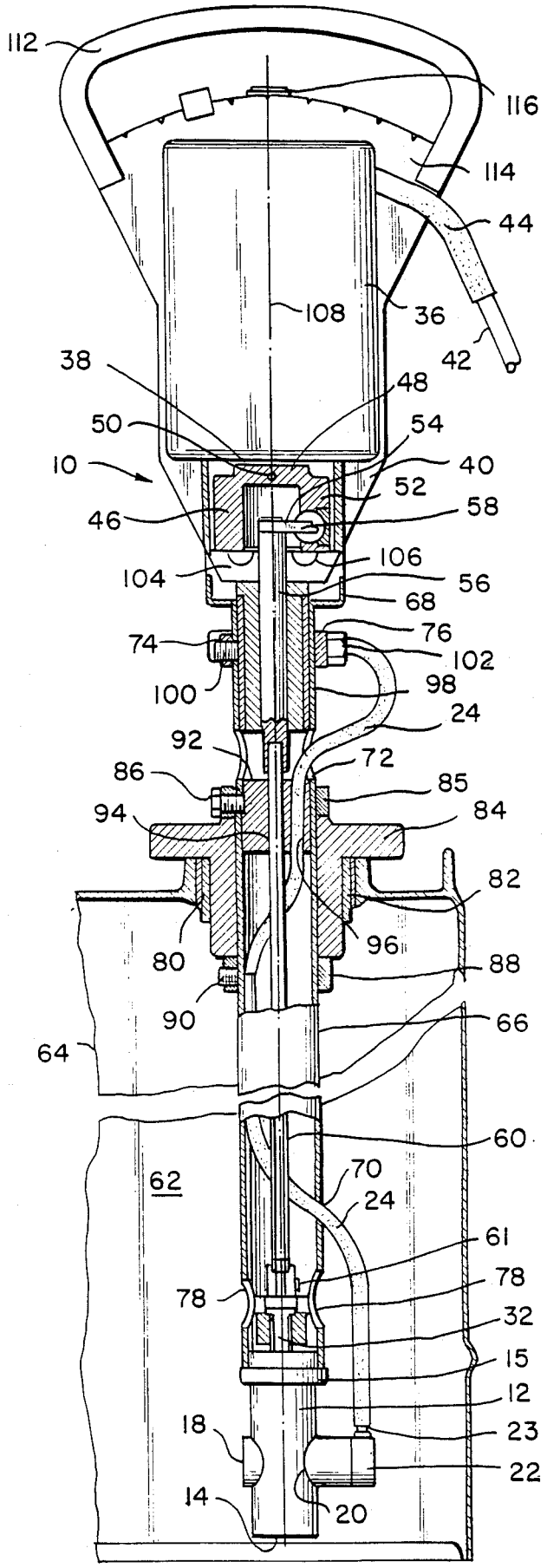
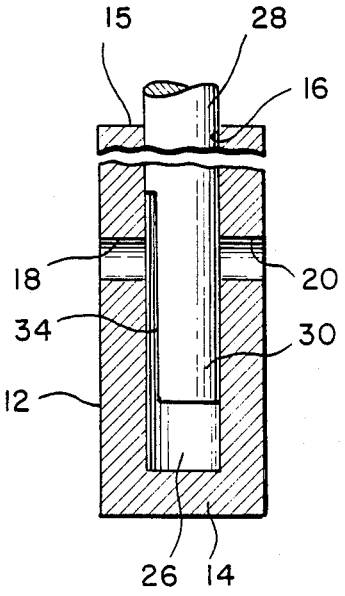
FIG. 3

SUBMERSIBLE POSITIVE DISPLACEMENT PISTON PUMP

BACKGROUND OF THE INVENTION

The present invention relates generally to positive displacement piston pumps and, more particularly, is directed to a submersible positive displacement piston pump having particular applicability to the delivery of small quantities of liquid to an application device.

For metering small amounts of liquid from a transport drum to an application device, it is well known to use pumps. For example, U.S. Patent No. 4,583,920, and having a common assignee herewith, describes an air driven diaphragm pump which discharges liquid pulses at a constant rate and which is used to transfer a few liters of chemicals per day from a transport drum to an application point. The application point, as an example, can be a coating hood for coating glass bottles.

An advantage of this pump is that it uses air pressure operated valves which prevent liquid leakage commonly found in pumps using conventional ball check valves. However, while this pump produces good results, differences in stroke volume of, for example, 20%, due to workmanship and membrane quality, may exist between different air driven diaphragm pumps.

In order to overcome these deficiencies, positive displacement piston pumps, such as disclosed in U.S. Patent Nos. 3,168,872; 3,257,953; and 4,008,003, and particularly, as modified in U.S. Patent No. 4,536,140 having a common assignee herewith, have been used. The entire disclosure of U.S. Patent No. 4,536,140 is incorporated herein by reference. The pump in the latter U.S. Patent has been found suitable for pumping liquid organometallic compounds used in the coating of glass bottles with tin oxide or other metal oxides.

With such pumps, the pumping chamber is kept out of th transport drum and a hose from the fluid inlet extends into the drum. Thus, the chemicals are pumped out of the drum, through the hose, and into the pumping chamber. However, as discussed in U.S. Patent No. 4,536,140, a problem with positive displacement piston pumps is that the chemical may migrate from the pumping chamber to a space between the piston and cylinder walls, even with the closet of tolerances between the reciprocating piston and the interior cylinder wall. Where the chemical is a corrosive material such as a monobutyltin trichloride containing formulation, the minute migration of liquid chemical may result in the build-up of metalhydroxy compounds between the reciprocating piston and inner cylinder wall. Such compounds are formed by reaction of the chemical with water vapor in ambient air. Because of such build-up, the piston may freeze in the cylinder, causing failure of the apparatus.

The aforementioned U.S. Patent No. 4,536,140 attempts to overcome these deficiencies by providing a separate oil barrier with constant oil pressure between the piston and inner cylinder wall. However, the use of such a barrier greatly complicates the apparatus. Further, the sealing oil, dependent upon the application, may interfere with the pump operation.

Another problem with such pumps is that minute amounts of air entering the pump may interfere with proper operation, resulting in a lower pumping rate. Specifically, gases, such as air, hydrogen, carbon dioxide and the like which are carried in the fluid, are often released in the cylinder as a result of agitation of the fluid during the pumping operation or as a result of pressure and temperature changes. For example, some fluids respond to agitation and/or pressure and temperature changes by chemically separating into liquid and gas fractions, while other fluids simply vaporize, physically changing from liquid to gaseous form. The problem that results is that the gases form bubbles which become trapped in the pumping head of the cylinder, thereby spoiling the metering precision of the pump, and in some situations, blocking flow completely. Generally, the gas bubbles become trapped between the recessed section of the piston and the inner wall of the cylinder.

Specifically, when the pump is not operating at full capacity, that is, when the piston is pivoted to less than its maximum extent, the piston is caused to reciprocate over a lesser distance between its retracted position and extended position. As a result, the top of the recessed section remains above the outlet port at all times during reciprocation of the piston. Gas bubbles formed between the recessed section and the inner wall of the cylinder thereby remain during the pumping operation, adversely affecting the same. It will be appreciated that the smaller the piston stroke, the more gas that will be trapped by the recessed section, thereby increasing the ratio of volume of entrapped gas to pump displacement. In other words, the pump becomes gas sensitive.

Because of this problem, a pump operating at less than maximum capacity must have its flow rate changed several times. Entrapped gas will then flow out of the pump, restoring its set delivery rate. However, such capacity changes are bothersome and time consuming. When used, for example, for pumping fluid to coat bottles, such capacity changes cause excess usage of expensive coating chemicals or cause insufficient coating on the bottles.

This latter problem of minute amounts of air entering the pump has been solved by the invention of U.S. Patent 4,575,317, the entire disclosure of which is incorporated herein by reference.

OBJECTS AND SUMMARY OF THE INVENTION

Accordingly, it is an object of the present invention to provide a positive displacement piston pump that inhibits freezing of the piston in the cylinder.

It is another object of the present invention to provide a positive displacement piston pump that prevents build-up of metalhydroxy compounds between the reciprocating piston and inner cylinder wall.

It is still another object of the present invention to provide a positive displacement piston pump that eliminates the need to use a barrier fluid.

It is yet another object of the present invention to provide a positive displacement piston pump that prevents undesirable bubble formation in the cylinder chamber.

In accordance with an aspect of the present invention, a pump includes cylinder means for insertion within a body of liquid, the cylinder means including an inlet port and an outlet port; piston means rotatably and reciprocably movable in the cylinder means for pumping liquid from the inlet port to the outlet port, the piston means including a recessed section alternately in fluid communication with the inlet port and the outlet port; a pivoting assembly pivotally connected to drive means for rotatably and reciprocably driving the piston means in the cylinder means; and extension means for connecting the pivoting assembly to the piston means and for ensuring that the pivoting assembly and the drive means are positioned out of the body of liquid when the piston means is positioned in the body of liquid.

In accordance with another aspect of the present invention, a pump includes cylinder means for insertion within a body of liquid, the cylinder means including a working end, an inlet port, an outlet port and a working chamber bounded by the outlet port and the working end; piston means rotatably and reciprocably movable in the cylinder means between a retracted position and an extended position for pumping liquid from the inlet port to the outlet port, the piston means including a free end having a recessed section alternately in fluid communication with the inlet port and the outlet port; a pivoting assembly pivotally connected to drive means for rotatably and reciprocably driving the piston means in the cylinder means; means for ensuring that the recessed section is positioned entirely in the working chamber when the piston means is in the extended position, regardless of the angle between the piston means and the drive means; and extension means for connecting the pivoting assembly to the piston means and for ensuring that the pivoting assembly and the drive means are positioned out of the body of liquid when the piston means is positioned in the body of liquid.

The above and other objects, features and advantages of the present invention will become readily apparent from the following detailed description which is to be read in connection with the accompanying drawings.

BRIEF DESCRIPTION OF THE DRAWINGS

FIG. 1 is a partial longitudinal cross-sectional view of a submersible positive displacement piston pump according to one embodiment of the present invention;

FIG. 3 is a partial cross-sectional view of the piston-cylinder end of the pump of FIG. 1.

DETAILED DESCRIPTION OF A PREFERRED EMBODIMENT

Figure 2:
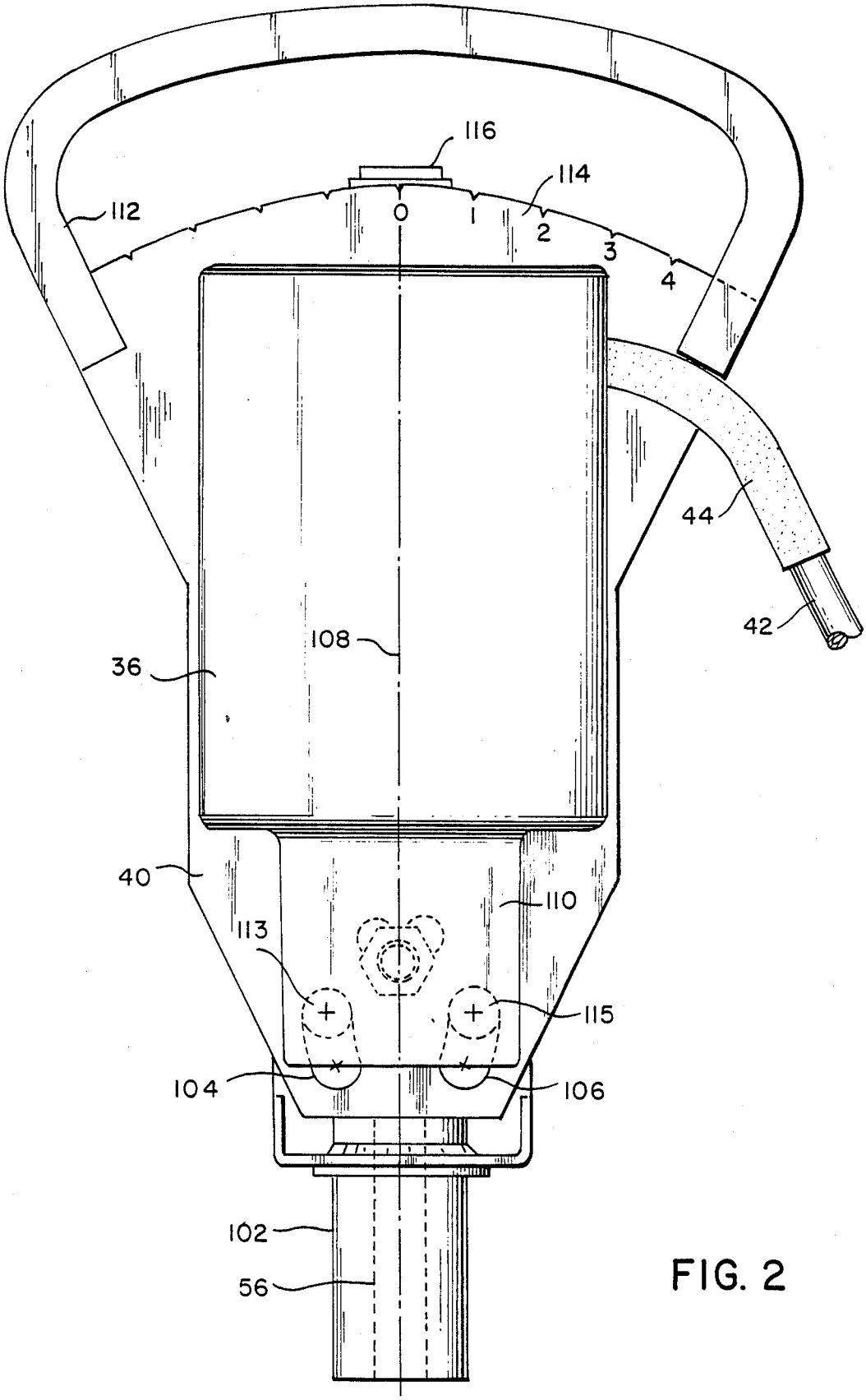
FIG. 2 is a plan view, partly in phantom, of a portion of the pump of FIG. 1.

Referring to the drawings in detail, and initially to FIG. 1 thereof, a submersible positive displacement piston pump 10 according to one embodiment of the present invention is shown which is suitable, for example, for pumping liquid organometallic compounds used in the coating of glass bottles with tin oxide or other metal oxides.

As shown in FIGS. 1 and 3, pump 10 includes a hollow cylinder 12 having a closed working end 14 and an opposite end 15 having a bore 16 therein. Diametrically opposite inlet and outlet ports 18 and 20, respectively, are formed in cylinder 12, adjacent working end 14. An outlet connection 22 is secured externally of cylinder 12 in surrounding relation to outlet port 20 and includes a coupling 23 for attaching one end of a delivery hose 24. The fluid to be pumped is therefore pumped from outlet port 20 to delivery hose 24. A working chamber 26 is also formed in cylinder 12, being bounded by working end 14 and ports 18 and 20, and is in fluid communication with ports 18 and 20.

A piston 28 is rotatably and reciprocably positioned in cylinder 12 through bore 16, and includes a free end 30 and a driven end 32. Free end 30 is formed with a flat, recessed section 34 which is alternately in fluid communication with ports 18 and 20 as piston 28 rotates within cylinder 12. Thus, recessed section 34 functions as a duct between ports 18 and 20, alternately opening and closing each port 18 and 20 in sequence. Recessed section 34, together with that portion of working chamber 26 at the head of piston 28, cooperates in forming the cylinder pumping chamber, whereby fluid is pumped between ports 18 and 20.

At the opposite end of pump 10, there is provided a drive motor 36 having an output drive shaft 38, and which is mounted on a base plate 40. An electric cable 42 extends through a cable protection hose 44 which is connected to the housing of motor 36, for supplying power to the motor. A collar or yoke 46 having a reduced boss 48 is keyed to drive shaft 38 by any suitable means, such as a pin 50 extending through reduced boss 48 and drive shaft 38. Yoke 46 is provided with a socket 52. One end of a laterally projecting or transverse arm 54 is secured to one end of a shaft 56, and the opposite end of arm 54 has a ball or spherical bearing 58 secured thereto. Ball 58 is received in socket 52 to form a universal ball and socket joint. Thus, as drive shaft 38 rotates, shaft 56 is caused to rotate and reciprocate in a manner well known and described in the above-mentioned U.S. Patents relating to positive displacement piston pumps.

It will be appreciated that such ball and socket joint arrangement permits pivoting of drive shaft 38 with respect to shaft 56. It is well known that the amount of reciprocation (and therefore the position of piston 28 in cylinder 12) will vary depending on the angle at which drive shaft 38 is pivoted with respect to shaft 56. Thus, the pump stroke will vary depending on such angle. For example, when drive shaft 38 is pivoted with respect to shaft 56 to its maximum extent, that is, when the pump is operating at maximum pump stroke, the piston reciprocates over a maximum distance between its retracted position and extended position in cylinder 12.

In accordance with the present invention, piston 28 is connected to shaft 56 by a shaft extension 60, whereby motor 36 controls the rotation and reciprocation of piston 28 in cylinder 12. A piston connector 61 is connected to the lower end of shaft extension 60 for connecting piston 28 thereto. With this arrangement, cylinder 12 and piston 28 are submerged at the bottom of a body of liquid 62 contained in a drum 64, while motor 36 and related parts at the drive end of the assembly are maintained out of the drum and liquid.

This provides distinct advantages not achieved with the prior art. Specifically, since the compounds in the cylinder are not exposed to ambient air, the problem of metalhydroxy compounds being formed in a space between the piston and cylinder walls, is overcome. As a result, there is no freezing of the piston in the cylinder. Further, because such disadvantage of the prior art devices is overcome, there is no need to use an oil barrier, as described in U.S. Patent No. 4,536,140.

As shown in FIG. 1, shaft extension 60 is surrounded by a hollow extension pipe 66 which is sealingly secured at its lower end to the upper end 15 of cylinder 12, and which extends out of drum 64 and is secured at its upper end to a bracket 68. Base plate 40 is also secured to bracket 68. Extension pipe 66 includes an aperture 70 at the lower end thereof and an aperture 72 at the end extending out of drum 64. In this manner, delivery hose 24 extends through lower aperture 70, through extension pipe 66 and out of upper aperture 72, where it is connected to a coupling 74 secured to the outside of extension pipe 66 by means of a lock ring 76.

In addition, extension pipe 66 is provided with a further set of apertures 78 at the lower end thereof, which are positioned a small distance above the connection thereof to cylinder 12. Accordingly, since extension pipe 66 is sealed to the upper end of cylinder 12, even if the drum is emptied of liquid (or the liquid level falls below the upper level of cylinder 12), liquid is still present where piston 28 extends out of cylinder 12. This provides a liquid seal at the upper end of cylinder 12, thereby avoiding the formation of metalhydroxy compounds between the piston and inner cylinder wall, since no air or water vapor enters into the pump (except when changing drums). As a result, there is no need to use any sealing oil, which may interfere with the pump operation. This also avoids the need to provide apparatus for maintaining sufficient oil pressures.

It will be appreciated that apertures 78 are formed at a height sufficient to provide the aforementioned seal, while also permitting liquid contents to be drained when changing drums.

As shown in FIG. 1, drum 64 is provided with an aperture 80 at its upper end through which extension pipe 66 extends and at which point extension pipe 66 is secured to drum 64. Specifically, drum aperture 80 is provided with a bondle thread 82, and a bondle cap 84 having external screw threads is provided in surrounding relation to extension pipe 66 for matingly engaging with bondle thread 82 and providing a seal for drum aperture 80. A lock ring 85 is secured to extension pipe 66 just above bondle cap 84 by means of a bolt 86, and a lock ring 88 is secured to extension pipe 66 just below bondle cap 84 by means of a bolt 90. In this manner, bondle cap 84 is secured to extension pipe 66, and extension pipe 66 is secured to drum 64.

A pipe closure 92 is provided inside the upper end of extension pipe 66 and is secured thereto by means of bolt 86 which, as aforesaid, also secures lock ring 85 to extension pipe 66. Pipe closure 92 is provided with an axially extending central aperture 94 to permit passage therethrough of shaft extension 60, and is further provided with another axially extending aperture 96 to permit passage of delivery hose 24 therethrough.

As also shown in FIG. 1, a bracket plate 98 is secured coaxially within the upper end of extension pipe 66 by means of a bolt 100 which also secures coupling 74 to the outside of extension pipe 66. Bracket plate 98, in turn, has a drive bearing 102 secured therewithin, and drive bearing 102 surrounds shaft 56 to permit shaft 56 to rotate and reciprocate therein.

As previously discussed, however, gases, such as air, hydrogen, carbon dioxide and the like which are carried in the fluid, are often released in the pumping chamber of cylinder 12 as a result of agitation of the fluid during the pumping operation or as a result of pressure and temperature changes. As a result, the released gases form bubbles which become trapped in the pumping chamber of cylinder 12, thereby spoiling the metering precision of pump 10, and in some situations, blocking flow completely, particularly where the pump is operating at less than maximum capacity, that is, when drive shaft 38 is pivoted with respect to shaft 56 at an angle less than its maximum extent. Generally, the gas bubbles become trapped between recessed section 34 of piston 28 and the inner wall of cylinder 12, as discussed more fully in aforementioned commonly assigned U.S. Patent No. 4,575,317 the entire disclosure of which has been incorporated herein by reference.

In order to overcome this problem, the above U.S. Patent provides an arrangement which shifts the retracted and extended positions of piston 28 within cylinder 12, without changing the piston stroke, for any angular displacement of drive shaft 38 with respect to shaft 56. As a result, the flow rate remains the same, while eliminating the problem of trapped gas.

Specifically, as shown in FIG. 2, base plate 40 is provided with two elongated, slightly arcuate slots 104 and 106 which are elongated in the general direction of a center line 108 which extends along the axis of shaft extension 60 and piston 28, the slots being positioned on opposite sides of center line 108.

A friction plate 110 to which yoke 46 and motor 36 are secured includes two pivot pins 113 and 115 (shown in phantom in FIG. 2), which fit within respective slots 104 and 106. Thus, pivoting of motor 36, which can be accomplished by a holding grip 112 (secured to base plate 40) and moving motor 36, results in yoke 46 pivoting with respect to shaft 56 due to the aforementioned ball and socket connection. This, in turn, changes the pump stroke, which can be measured by means of a scale 114 and pointer 116 adjacent grip 112.

Generally, the distance between pivot pins 113 and 115 is approximately equal to the diameter of the circle travelled by the center of ball 58 during each revolution of yoke 46.

Because of this arrangement, the aforementioned problems with respect to air entering the working chamber in the cylinder of a conventional pump are avoided.

Having described a specific preferred embodiment of the invention with reference to the accompanying drawings, it will be appreciated that the present invention is not limited to that precise embodiment, and that various changes and modification can be effected therein by one of ordinary skill in the art without departing from the scope or spirit of the invention, as defined by the appended claims.

What is claimed is:

1. A pump comprising:

cylinder means for insertion within a body of liquid, said cylinder means including a working end and end opposite to said working end, an inlet port, an outlet port and a working chamber bounded by said outlet port and said working end;

piston means rotatably and reciprocably movable in said cylinder means between a retracted position and an extended position for pumping liquid from said inlet port to said outlet port, said piston means including a free end having a recessed section alternately in fluid communication with said inlet port and said outlet port;

a pivoting assembly pivotally connected to drive means for rotatably and reciprocably driving said piston means in said cylinder means;

means for ensuring that said recessed section is positioned entirely in said working chamber when said piston means is in said extended position, regardless of the angle between said piston means and said drive means; and extension means for connecting said pivoting assembly to said piston means and for ensuring that said pivoting assembly and said drive means are positioned out of said body of liquid when said piston means is positioned in said body of liquid, wherein said extension means includes a shaft extension for connecting said pivoting assembly to said piston means, and a hollow extension pipe surrounding said shaft extension, said extension pipe being connected to said opposite end of said cylinder means in a sealing relation therewith and having an aperture spaced slightly from said sealing connection for maintaining a liquid seal at said opposite end of said cylinder means when the level of said body of liquid falls below said opposite end of said cylinder.

2. A pump according to claim 1; wherein said means for ensuring includes guide means for guiding said drive means during pivotal movement of said drive means with respect to said piston means to ensure that said recessed section is positioned entirely in said working chamber when said piston means is in said extended position.

3. A pump according to claim 2; wherein said guide means includes base plate means; two elongated, slightly arcuate slots on one of said base plate means and said drive means, said slots extending on opposite sides of and in the general direction of a center line of said pump; and two pin means on the other of said base plate means and said drive means, said two pin means extending in said two slots, respectively, for guiding said drive means during pivotal movement of said drive means with respect to said piston means to ensure that said recessed section is positioned entirely in said working chamber when said piston is in said extended position.

4. A pump according to claim 1; further including hose means secured to said outlet port of said cylinder means, and wherein said extension pipe includes an aperture at a lower end thereof and an aperture at an upper end thereof for permitting passage of said hose means through said extension pipe.

5. A pump according to claim 1; wherein said pivoting assembly includes yoke means connected to said drive means and having a socket therein, arm means connected to and extending generally transverse from said shaft extension, and a ball mounted on said arm means and mating with said socket in a ball and socket arrangement.

6. A pump according to claim 1; wherein said body of liquid is contained in a container having an aperture at an upper end thereof; and further including means for securing said extension pipe to said container such that said extension pipe extends through said aperture of said container.

7. A pump according to claim 6; wherein said means for securing includes a bondle thread arrangement.

8. A submersible positive displacement piston pump for use with a drum of liquid and driven by drive means having a continuously rotating output shaft, said pump comprising:

(a) cylinder means for insertion within said drum of liquid, said cylinder means including a first working end with an inlet port and an outlet port, and a second opposite end having an upper surface:

(b) piston means rotatably and reciprocally movable in said cylinder means for pumping liquid from said inlet port to said outlet port, said piston means including a first end with a recessed section alternately in fluid communication with said outlet port and said outlet port and a second opposite end extending out of the upper surface at said second end of said cylinder means;

(c) connections means for connecting said piston means to cause continuous rotation and reciprocation of said piston means in said cylinder means, with said drive means being positioned out of said drum, and said piston means and cylinder means being positioned within said drum, said connection means including:

(i) a pivoting assembly connected to said drive means and having an output shaft which continuously rotates and reciprocates and extension means for connecting said output shaft of said pivoting assembly to said piston means so that said pivoting assembly and said drive means are positioned out of said drum of liquid and said piston means and said cylinder means are positioned in said drum of liquid, said extension means having (1) an extension shaft with a first end connected to said output shaft of said pivoting assembly and a second, opposite end connected to said piston means; and (2) a hollow extension pipe surrounding said extension shaft and having a lower end connected in sealing relation to said second end of said cylinder means, said extension pipe having an aperture therein to permit the entry of liquid into said extension pipe and to thereby define a cup-like area bounded by a portion of said extension pipe below said aperture and said upper surface at the second end of said cylinder means, the provide a liquid seal at the upper surface of the cylinder means.

9. A pump according to claim 8 wherein said pivoting assembly includes yoke means connected to said drive means and having a socket therein, arm means connected to and extending generally transverse from said shaft extension and a ball mounted on said arm means and mating with said socket in a ball and socket arrangement.

10. A pump according to claim 8 wherein said drum of liquid has a aperture at an upper end thereof; and further including means for securing said extension pipe to said drum such that said extension pipe extends through said aperture in said drum.

11. A pump according to claim 10 wherein said means for securing includes a threaded cap screw-threadedly received in said drum for securing said extension pipe to said drum.

12. A submersible positive displacement pump according to claim 8 wherein said cylinder means includes a working chamber and said piston means is rotatably and reciprocably movable in said cylinder means between a retracted position and an extended position for pumping liquid from said inlet port to said outlet port, and further comprising means for ensuring that said recessed section is positioned entirely in said working chamber when said piston means is in said extended position, regardless of the angle between said piston means and said drive means.

13. A pump according to claim 12 wherein said means for ensuring includes guide means for guiding said drive means during pivotal movement of said drive means with respect to said piston means to ensure that said recessed section is positioned entirely in said working chamber when said piston means is in an extended position.

14. A pump according to claim 13 wherein said guide means includes base plate means; two elongated, slightly arcuate slots on one of said base plate means and said drive means, said slots extending on opposite sides of and in the general direction of said pump; and two pin means on the other of said base plate means and said drive means, said two pins extending in said two slots, respectively, for guiding said drive means during pivotal movement of said drive means with respect to said piston means to ensure that said recessed section is positioned entirely in said working chamber when said piston is in said extended position.

* * * * *